US008421695B2

(12) United States Patent
Friman et al.

(10) Patent No.: US 8,421,695 B2
(45) Date of Patent: Apr. 16, 2013

(54) MULTI-FREQUENCY, NOISE OPTIMIZED ACTIVE ANTENNA

(75) Inventors: Alf Friman, Växjö (SE); Xiaomeng Su, San Diego, CA (US); Laurent Desclos, San Diego, CA (US)

(73) Assignee: Ethertronics, Inc., San Diego, CA (US)

( * ) Notice: Subject to any disclaimer, the term of this patent is extended or adjusted under 35 U.S.C. 154(b) by 435 days.

(21) Appl. No.: 12/758,662

(22) Filed: Apr. 12, 2010

(65) Prior Publication Data

US 2010/0259457 A1 Oct. 14, 2010

Related U.S. Application Data

(60) Provisional application No. 61/168,547, filed on Apr. 10, 2009.

(51) Int. Cl.
*H01Q 1/50* (2006.01)

(52) U.S. Cl.
USPC ..... 343/745; 343/747; 343/876

(58) Field of Classification Search ..... 343/745, 343/747, 748, 750, 876
See application file for complete search history.

(56) References Cited

U.S. PATENT DOCUMENTS

| | | | | | |
|---|---|---|---|---|---|
| 1,819,299 | A | * | 8/1931 | Miller | 455/193.2 |
| 2,392,672 | A | * | 1/1946 | Koch | 455/205 |
| 2,430,173 | A | * | 11/1947 | Holmes | 455/92 |
| 2,681,445 | A | * | 6/1954 | Guanella | 370/533 |
| 2,874,274 | A | * | 2/1959 | Van Vechten et al. | 343/745 |
| 2,884,632 | A | * | 4/1959 | De Witz et al. | 343/850 |
| 3,381,222 | A | * | 4/1968 | Gray | 455/77 |

* cited by examiner

*Primary Examiner* — Tho G Phan
(74) *Attorney, Agent, or Firm* — Coastal Patent Agency; Joshua Schoonover

(57) ABSTRACT

A multi-frequency, noise optimized active antenna consisting of one or several actively tuned antennas optimized over incremental bandwidths and capable of tuning over a large total bandwidth. One or multiple impedance transformers are connected to the antennas at an optimal location, with the transformers acting to reduce the impedance for optimal coupling to a transceiver/receiver. Active components can be incorporated into the antenna structures to provide yet additional extension of the bandwidth along with increased optimization of antenna performance over the frequency range of the antenna. The radiating elements can be co-located with a ferrite material and/or active components coupled to the element to tune across a wide frequency range.

10 Claims, 6 Drawing Sheets

MULTI-FREQUENCY, NOISE OPTIMIZED ACTIVE ANTENNA

FIELD OF THE INVENTION

The present invention relates generally to the field of wireless communication. In particular, the present invention relates to an antenna for use within such wireless communication; and more specifically, the present invention provides an antenna system designed to transmit and receive data over a broad spectrum of instantaneous bandwidths for media applications within such wireless communication.

BACKGROUND OF THE INVENTION

The continual search for additional frequency bandwidth and efficiency from antennas in wireless systems points to the need for new approaches. Increasing frequency bandwidth of internal antennas for media applications in cell phones is a prime example. More specifically, FM radio and DVB-H TV reception are requirements in a large number of mobile phones. Antenna performance is a key parameter for good reception quality. Mobile handsets are very small compared to wavelengths at FM and DVB-H frequencies; accordingly the antennas used for these applications on handsets will be electrically small. These electrically small antennas will be narrow band and require low loss matching techniques to preserve efficiency. Multiple electrically small antennas embedded in a small wireless device will tend to couple, thereby degrading performance. The reduced volume allowed for an internal antenna coupled with the strict requirement that the internal FM and DVB-H antennas must not interfere with the main antenna or other ancillary antennas in the handset makes the task of antenna matching across the wide range of frequencies quite difficult.

Current market-available antenna designs and prior art antennas are not suitable for overcoming the aforementioned problems. Commonly owned U.S. patent application Ser. No. 12/117,669, hereinafter referred to as '669 discloses antenna embodiments useful over certain FM frequencies, the entire disclosure of which is hereby incorporated by reference. Although useful in many applications, the '669 application does not disclose the use of an impedance transformer for matching the antenna with a transceiver.

Taking into consideration the requirements for the next generation of devices along with the deficits of current technologies, a solution is needed which achieves efficiency from an internal antenna required to cover the large FM frequency band. Antennas commonly known and available which generally cover the entire frequency range tend to display inadequate antenna radiation efficiency at a fixed volume. There is an immediate need for improved antenna systems for providing efficient operation over FM and DVB-H frequencies while further providing a component volume capable of integration within strict and often very small design requirements of modern portable devices. There is a need for such antenna systems that will further reduce or eliminate interference with other antennas or wireless components in the portable device.

SUMMARY OF THE INVENTION

It is a goal of the various embodiments of the present invention to provide an enhanced antenna system which successfully enables efficient operation over FM and DVB-H frequencies while providing a component volume capable of integration within the strict design requirements of modern portable wireless devices. The antenna system must further operate without interference with the main antenna or other wireless components of the portable wireless device.

In one embodiment, a solution is achieved by actively tuning the antenna over narrow instantaneous bandwidths. Compared to an antenna structure that covers the entire frequency range without tuning, the tunable antenna greatly improves the antenna radiation efficiency for the same physical volume constraint. Additional active tuned loops can be combined to extend the frequency range to cover wider bandwidths, thereby satisfying a wide range of antenna applications. With the ability to cover multiple octaves, FM and other media applications can be addressed with internal antennas which will provide the required efficiency.

In one embodiment of the invention an active tuning component is connected to an antenna. The active tuning component provides a reactance that cancels the reactance of the antenna, allowing for optimal radiation. A second active tuning component is connected to a second antenna. An impedance transformer is connected to the two antennas at a point of high voltage, with the impedance transformer acting to reduce the overall impedance for optimal coupling to a transceiver.

In another embodiment of the invention, the conductive loop is loaded with a ferrite material to increase the electrical performance of the loop. The conductive loop can be fabricated from or otherwise consist of a wire, a rectangular pattern, or a conductive pattern printed on the ferrite. An active tuning component is connected to the ferrite loaded loop antenna, with the active component adjusted to cancel the reactance of the antenna. An impedance transformer is connected to the loop at a point of high voltage, with the transformer acting to reduce the impedance for optimal coupling to a receiver.

In a general embodiment of the invention, multiple active tuned loops or coils are connected to extend the frequency range of the composite antenna. A single or multiple impedance transformers can be connected to multiple locations on the loops or coils to provide connection of the antenna to a single or multiple transceivers.

In another embodiment of the invention, multiple active tuned loops or coils are connected, and one or more radiating elements are connected or coupled to one or more of the active tuned loops or coils to form a composite antenna.

The active tuned component can be a varactor diode, tunable capacitor, switched capacitor network, or other components.

The impedance transformer can be a metal-oxide-semiconductor field-effect transistor (MOSFET) or any other type of semiconductor capable of transforming a high impedance to a lower impedance with small signal voltage losses.

The radiating element or elements connected to the active tuned loop or loops can be monopoles, IFAs (Inverted F Antenna), PIFAs (Planar Inverted F Antenna), IMD (Isolated Magnetic Dipole) elements, coils, or Dipoles or any other antenna known in the art.

In another embodiment of the invention, switches or other active components are coupled to the antenna to provide additional optimization in frequency response. The tuned loop is adjusted to provide optimization of the impedance match of the antenna along with optimization of the radiating structure.

While particular embodiments of the present invention have been disclosed, it is to be understood that various different modifications and combinations are possible and are contemplated within the true spirit and scope of the appended claims. There is no intention, therefore, of limitations to the exact abstract and disclosure herein presented.

BRIEF SUMMARY OF THE DRAWINGS

These and other attributes of the invention will become more clear upon a thorough study of the following description of the invention, particularly when reviewed in conjunction with the drawings, wherein.

DETAILED DESCRIPTION

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions.

In a general embodiment of the present invention, an antenna system is provided which comprises an antenna element, an active tuning component connected to the antenna element, and an impedance transformer. The antenna element and connected active tuning component define what is herein referred to as an active tuned element. The active tuned element is connected to the impedance transformer for matching the impedance of the antenna system with the impedance of a receiver, transmitter or transceiver. The impedance transformer should be connected to the active tuned element at a point of high voltage for maximum efficiency.

In various embodiments, multiple active antennas can be coupled together in order to extend the total bandwidth of the antenna. Such active components may be incorporated into the antenna structure to provide further extensions of the bandwidth along with increased optimization of antenna performance over the frequency range of the antenna.

In certain embodiments, the radiating element may be co-located with a ferrite material and active components coupled to the element to tune across a wide frequency range.

An antenna element as described herein is generally a conductive wire in the form of a loop or coil, however can be any component within an antenna system which receives or transmits electromagnetic energy. An antenna element is a transducer used to convert electromagnetic energy or waves into an electrical current or electrical current into electromagnetic energy.

Figure 8:
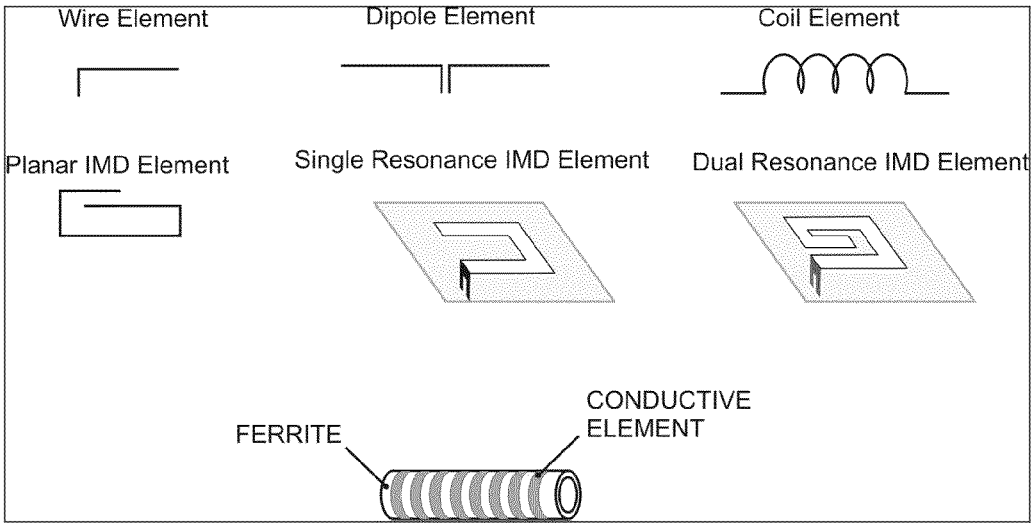
FIG. 8 illustrates a number of radiating elements that can be incorporated into the antenna system. The radiating elements are not limited to the types shown.

A radiating antenna component or otherwise herein referred to as a "radiating element" can be a length of conductive material in any shape or form which is capable of producing or radiating electromagnetic energy from an electrical source. Examples of radiating elements include but are not limited to those antenna types illustrated in FIG. 8. A radiating element can optionally be connected to an active tuning component to cancel the reactance of the radiating element.

An active tuning component is herein used to describe a component capable of adjusting or tuning the reactance of an antenna element. The term "reactance" used herein generally refers to capacitive reactance; however the term can also include inductance and resistance. Examples of active tuning components useful in this invention include: a varactor diode, tunable capacitor, switched capacitor network, or other components capable of cancelling the reactance of a circuit.

The term "active tuned element" is used herein to refer to the combination of an antenna element and an active tuning component. The active tuned element is simply an antenna element connected to an active tuned component, such that the active tuned component cancels the reactance of the antenna element to provide a resonant antenna for maximum efficiency.

An impedance transformer is generally used herein to describe a modular or other component capable of matching the impedance of the antenna system with the impedance of a receiver, transmitter or transceiver. Matched impedance between the source and the antenna allows for optimum efficiency and low power loss, ultimately improving antenna performance. Examples of impedance transformers include: a metal-oxide-semiconductor field-effect transistor (MOSFET), or any other type of semiconductor capable of transforming a high impedance to a lower impedance with small signal voltage losses.

In one embodiment of the invention, an antenna system is provided which is capable of efficient operation over FM and DVB-H frequencies while providing a component volume capable of integration within the strict design requirements of modern portable wireless devices, the antenna system comprises: an antenna element, an active tuning component connected to the antenna element to form an active tuned element, and an impedance transformer. In this embodiment, the antenna element is a conductive loop (also herein referred to as a coil element). The coil element is electrically connected to a tunable capacitor to form an active tuned loop. The active tuned loop is connected to a MOSFET at a point of high voltage, and the antenna system is connected to a receiver.

In another embodiment, the antenna system comprises two active tuned loops. Each active tuned loop comprises a coil element electrically connected to an active tuning component such as a tunable capacitor. Each active tuned loop is connected to an impedance transformer such as a MOSFET at a point of high voltage. The impedance transformer is then connected to a receiver, transmitter or transceiver.

In yet another embodiment, the antenna system comprises three or more active tuned loops which are connected to an impedance transformer as set forth in the previous example.

Where an antenna element is a loop or coil, a secondary element can be incorporated into the antenna system design. A secondary element is herein defined as an antenna element which is coupled to an active tuned loop or coil. Examples of secondary elements include radiating elements such as monopoles, IFAs (Inverted F Antenna), PIFAs (Planar Inverted F Antenna), IMD (Isolated Magnetic Dipole) elements, coils, or Dipoles or any other antenna known in the art.

One or more radiating elements can be incorporated into the antenna system design. A radiating element can be capacitively coupled to an active tuned element such as an active tuned loop. Alternatively, a radiating element can be electrically connected to an active tuned element. Optionally, multiple radiating elements can be coupled to a number of active tuned elements. The active tuned elements can then be connected to one or more impedance transformers for matching to a transceiver.

In another embodiment of the present invention, an antenna system is provided comprising a switched coil element or other switched antenna connected to multiple impedance transformers capable of operation over a large total bandwidth. The terms switched coil element and switched antenna are herein used interchangeably. A switched coil element comprises two or more coil regions. A first coil region is connected to a second coil region at a switch. When the switch is on, the second coil region is active, thus providing an extended antenna. Any number of coil regions and switches can be incorporated into the antenna. The switched antenna with impedance transformers is capable of both transmit and receive operation. Optionally, the switched antenna or switched coil element can be ferrite loaded to improve the performance of the antenna system.

Figure 1:
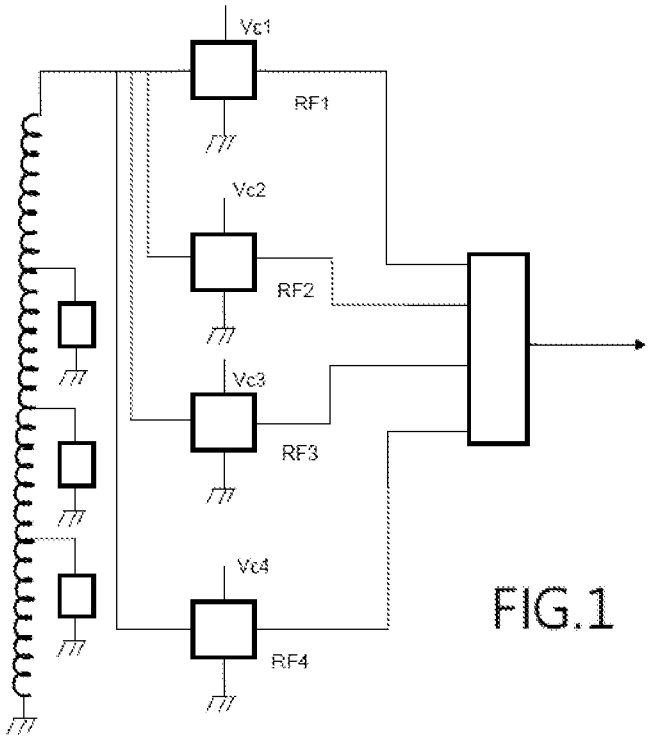
FIG. 1 is a block diagram illustrating four impedance transformers connected to an active antenna and a switch. The switch connects the four impedance transformers to a common receiver.

FIG. 1 illustrates a diagram of a switched antenna 40 connected to multiple impedance transformers 41, 42, 43, and 44; the impedance transformers are connected to a switch 45. The switch connects to a receiver to provide a wide band antenna for receive applications. The switched antenna has four coil regions 1-4, each coil region is separated by a switch.

Figure 2:
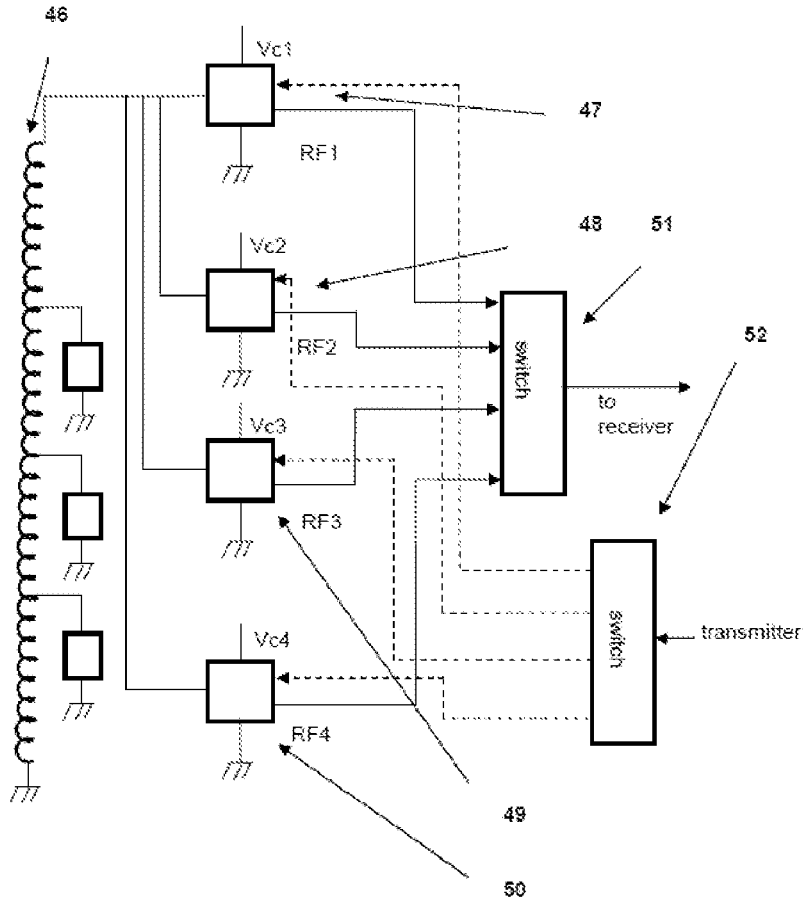
FIG. 2 is a block diagram illustrating four impedance transformers connected to an active antenna and two switches. The switches connect the four impedance transformers to both a common transmitter and a common receiver.

FIG. 2 illustrates a diagram of a switched antenna 46 connected to multiple impedance transformers 47, 48, 49, and 50; the impedance transformers are connected to two switches 51 and 52 , allowing for use with both a transmitter and receiver.

Figure 3:
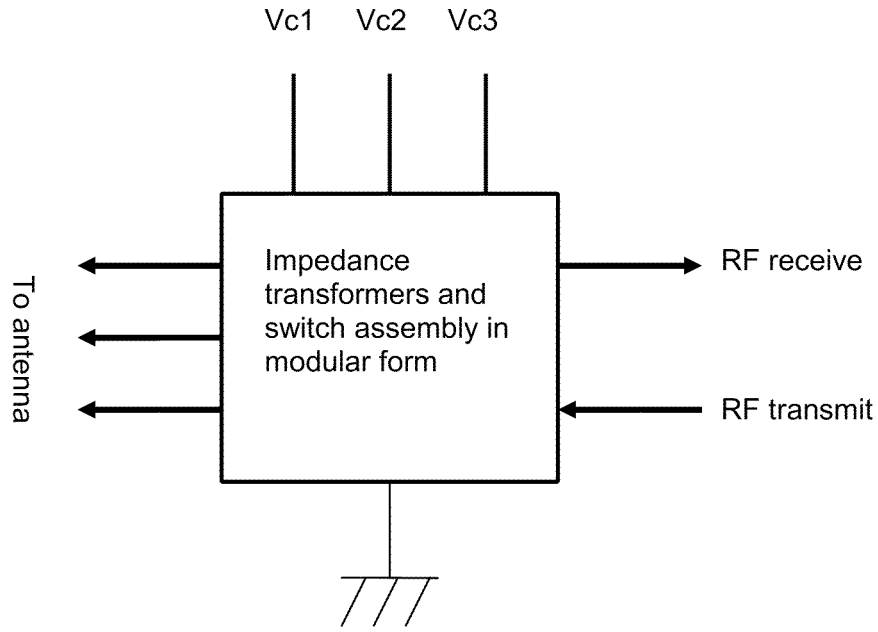
FIG. 3 illustrates a modular form of the impedance transformers and switch assembly as illustrated by the circuit of FIG. 2.

As illustrated in FIG. 3, multiple impedance transformers and switches can be combined into a modular assembly. In this implementation, the modular impedance transformer assembly can be mounted to a circuit board for connecting to the antenna system. An impedance transformer assembly can further incorporate one or more active tuning components for varying the reactance of an antenna element.

Active tuning of the antenna elements in certain embodiments of this invention enables the cancelling of reactance and can play a major part in design of a resonant antenna system. For example, an antenna system with omitted active components can yield low efficiency and high noise relative to the optimum threshold, whereas an active tuned antenna provides improved performance.

Figure 4:
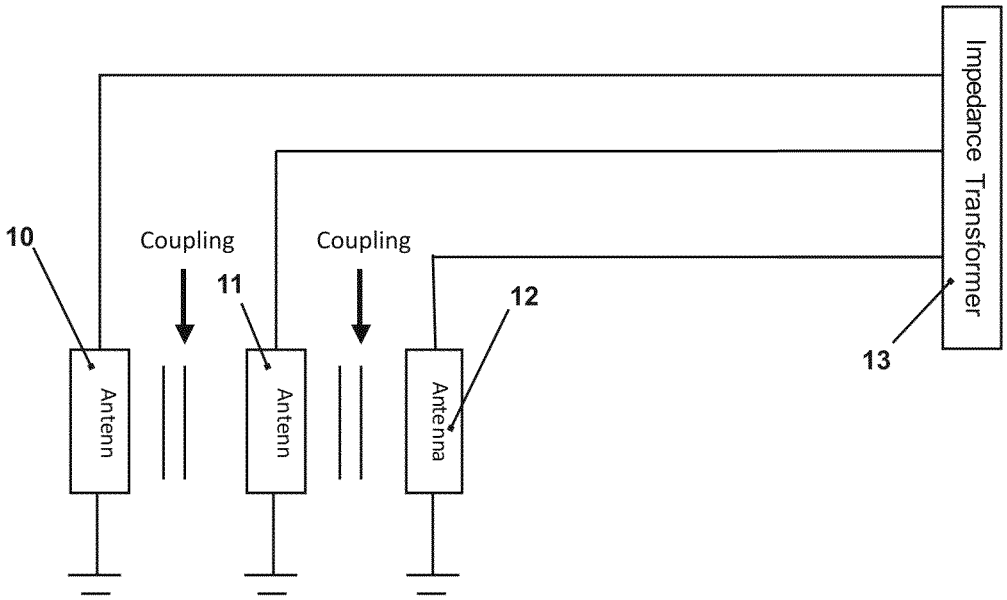
FIG. 4 is a block diagram of three antennas coupled together and connected to a single impedance transformer. This antenna system does not contain active tuning components.
Figure 4A:
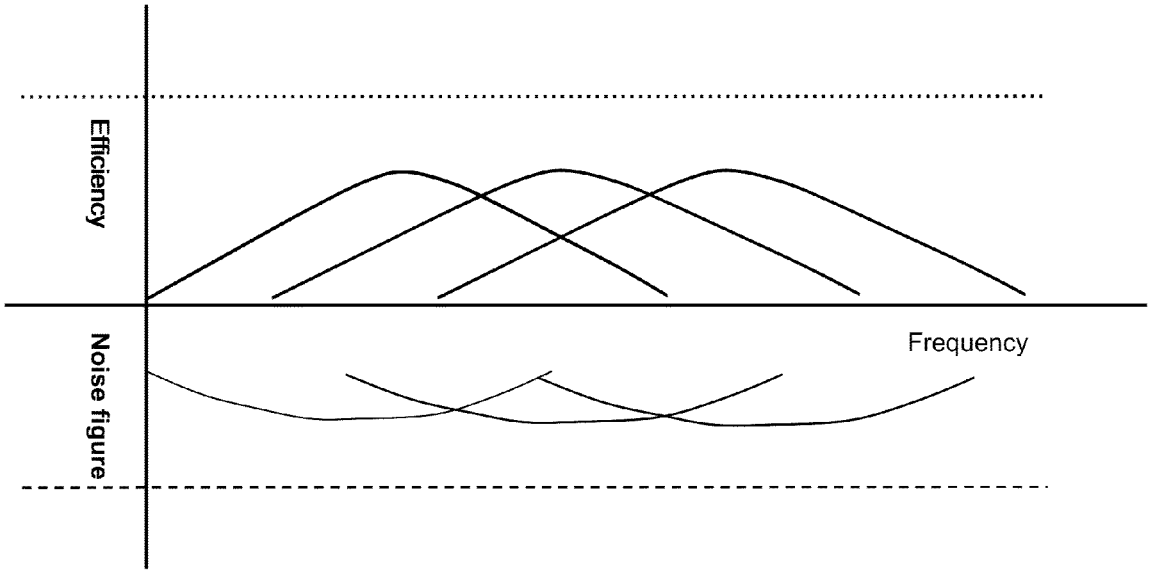
FIG. 4*a* illustrates a plot of antenna efficiency and noise figure performance from a composite antenna system consisting of three antenna elements coupled together but without the active components as illustrated in FIG. 4. The antenna efficiency and noise figure characteristics do not achieve the desired performance results denoted by the dotted lines.

FIG. 4 illustrates a block diagram of three antenna loops 10, 11 and 12 that are connected to an impedance transformer 13 without active components. Since there is no method of tuning the antenna loops, the efficiencies are low and noise figures are high as illustrated in FIG. 4*a*.

Figure 5:
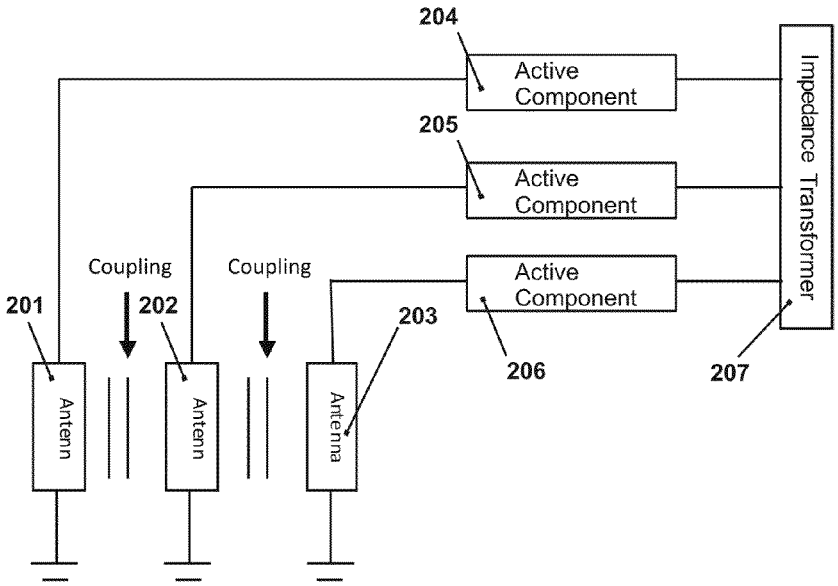
FIG. 5 is a block diagram illustrating a first active tuning component connected to a first antenna; the active component is in turn connected to an impedance transformer. A second active component and antenna pair are coupled to the same impedance transformer. This second antenna/active component pair is implemented to extend the frequency range of the antenna system. The impedance transformer is connected to the loop at a point of high voltage, with the transformer acting to not reduce the voltage for optimal coupling to a transceiver/receiver
Figure 5A:
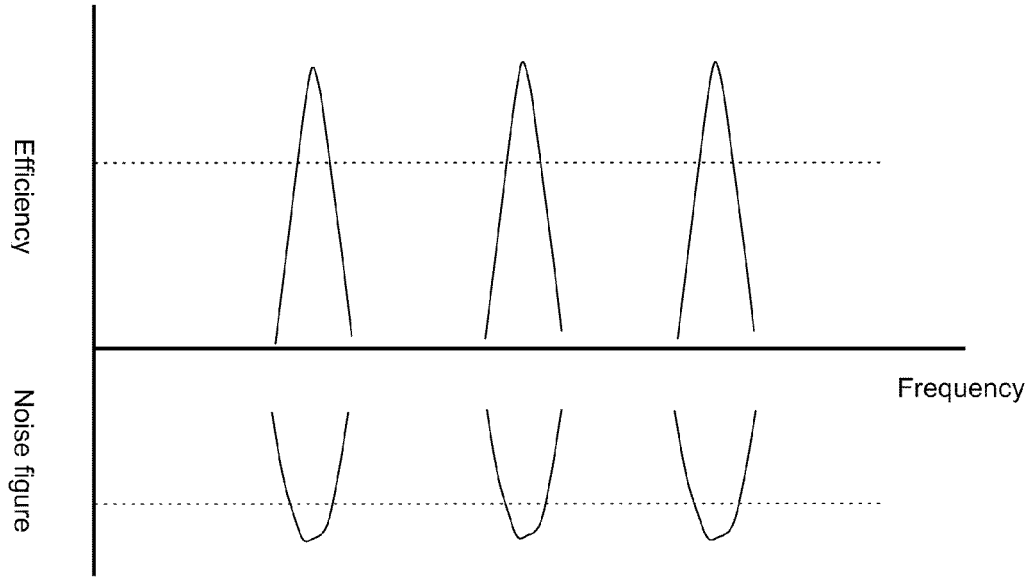
FIG. 5*a* is a plot of antenna efficiency and noise figure performance from a composite antenna system as illustrated in FIG. 5. The antenna efficiency and noise figure characteristics are improved due to optimized antenna impedance characteristics.

In contrast, certain embodiments of this invention are optimized with the inclusion of active tuning components in the antenna system. As an illustrative example, FIG. 5 represents a block diagram of three antennas 201; 202; and 203 that are connected through active components 204; 205; and 206 to an impedance transformer 207. The introduction of active components 204; 205; and 206 provides the cancelling of reactance and allows each antenna loop to be actively tuned. As represented in FIG. 5*a*, the introduction of active components to tune the antenna loops greatly increases the efficiency and lowers the noise of the antenna system.

Figure 6:
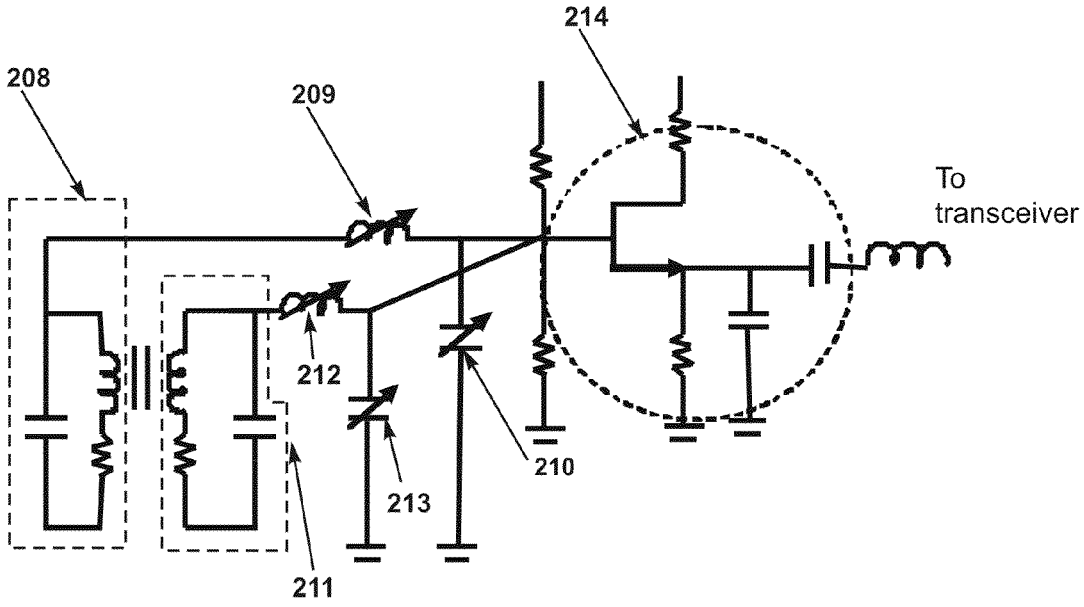
FIG. 6 illustrates a circuit implementation of two antenna loops coupled to an impedance transformer via active components.

Referring now to FIG. 6, a two-antenna circuit similar to the circuit of FIG. 5 is illustrated. Antenna loops 208 and 211 are shown with their corresponding reactive and resistive elements. Inductive reactance element 209 and capacitive reactance element 210 for loop 208; and elements 212 and 213 for loop 211, are used to tune each loop to its resonant frequency increasing the circuit efficiency and reducing the noise figure. Both circuits are connected to the impedance transformer 214. While this description is shown with two antenna loops, as many as physically possible may be included to satisfy design requirements.

Figure 7:
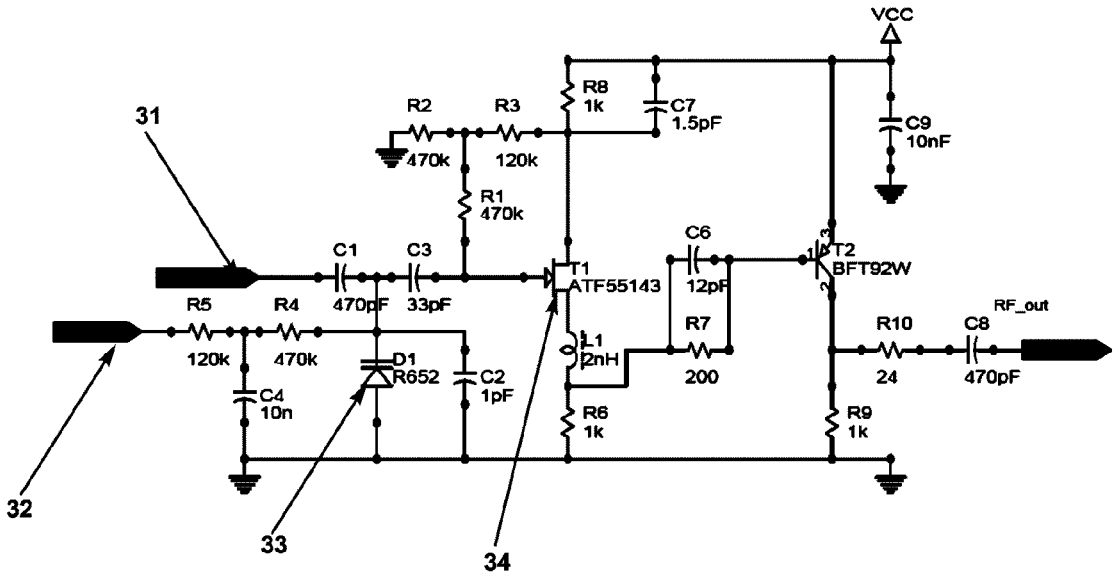
FIG. 7 illustrates a circuit that is optimized for FM reception, consisting of an antenna port that is connected to an active component for impedance optimization and frequency shifting, which is in turn connected to an impedance transformer.

Another embodiment of this invention is illustrated by FIG. 7 where the antenna loop 31 is tuned using a control voltage 32 and an active tuning element such as a varactor diode 33 is used to vary the resonant frequency of the antenna loop within a range as defined by the reactive elements of the antenna loop. A MOSFET impedance transformer circuit component 34 is used to match the tuned antenna loops to the receiver circuit.

Figure 7A:
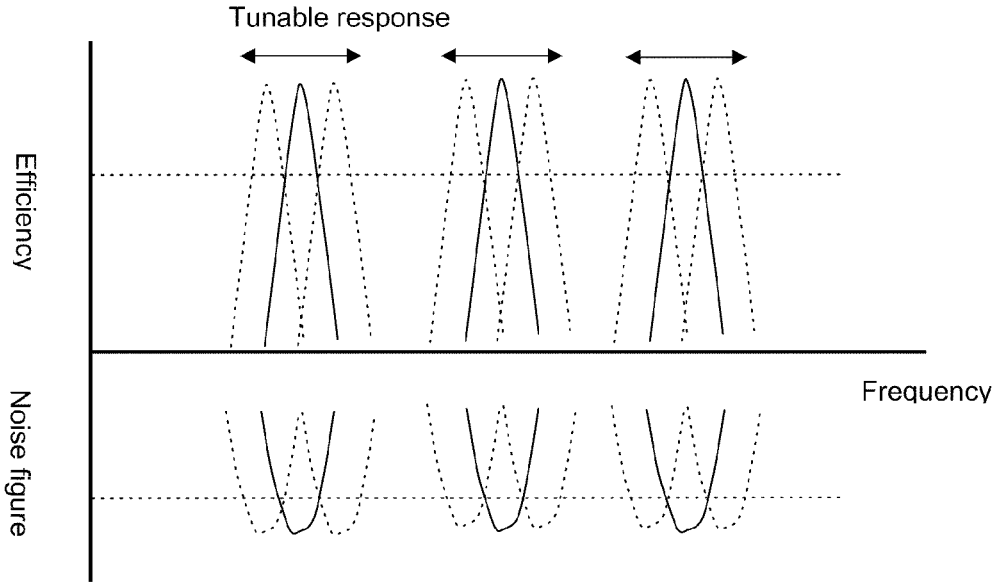
FIG. 7*a* shows a plot of antenna efficiency and noise figure performance as the active components are tuned to vary the frequency response while maintaining optimal antenna performance.

Referring now to FIG. 7*a*, a plot illustrates the effect of the ability to tune an antenna loop using an active component such as a varactor diode with a control voltage such as described in the previous embodiment of FIG. 7. Only three tuning steps are shown for clarity. As many steps as a particular antenna design requires can be achieved with smaller control voltage increments.

Figure 9:
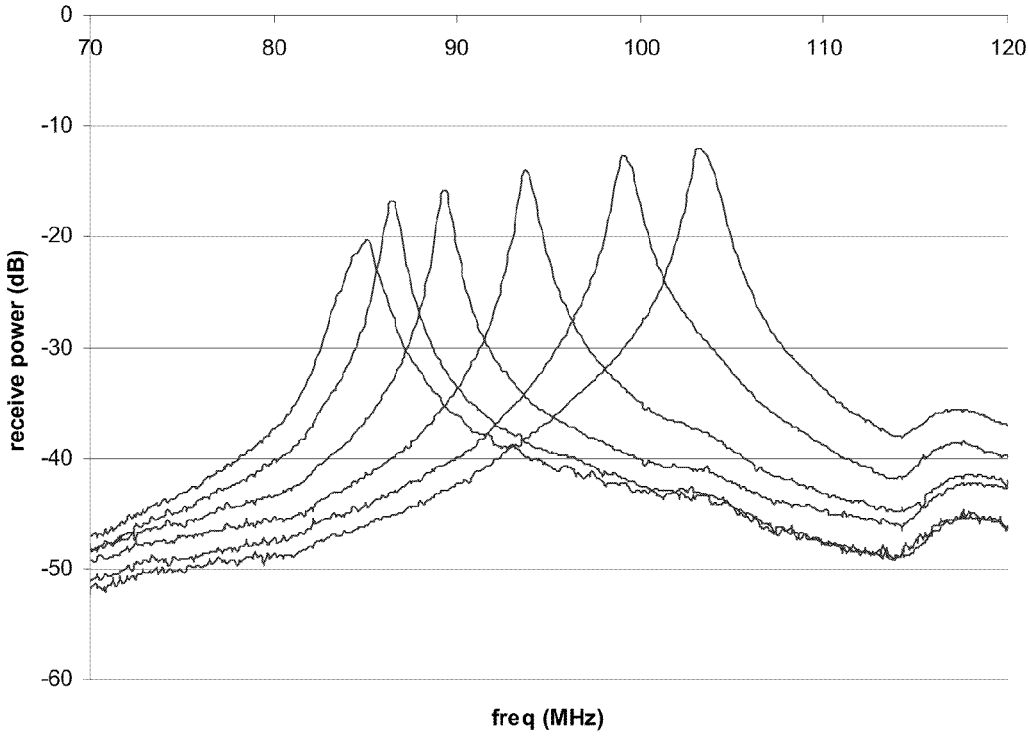
FIG. 9 is a plot of receive power as a function of frequency for multiple tuning states for the circuit shown in FIG. 7.

The inventors of the present application have recognized that strict design requirements of modern communications devices can be met by actively tuning a plurality of antenna loops over instantaneous bandwidths. The inventors of the present application have built and tested the antenna systems disclosed herein, and in particular the antenna system of FIG. 7. FIG. 9 is a plot of receive power measured over multiple tuning states for the antenna circuit shown in FIG. 7, confirming in fact that an antenna system can be designed and tuned over a series of instantaneous bandwidths using the embodiments disclosed herein.

The above examples are set forth for illustrative purposes and are not intended to limit the spirit and scope of the invention. One having skill in the art will recognize that deviations from the aforementioned examples can be created which substantially perform the same tasks and obtain similar results.

What is claimed is:

1. An antenna system, comprising;

a switched antenna element having at least a first portion coupled to a second portion at a first switch, the second portion being further coupled to a third portion at a second switch, wherein the switched antenna element has an adjustable length configurable between at least said first through third portions;

said switched antenna element being coupled to a plurality of impedance transformer assemblies;

said impedance transformer assemblies each further connected to at least one switch;

wherein the switch is connected to one or more of: a receiver, transmitter, or transceiver.

2. An antenna system, comprising;

an antenna element coupled to an impedance transformer module;

said impedance transformer module comprising:

an active component coupled to said antenna element and being configured to adjust a reactance of the antenna element, one or more impedance transformers coupled to the antenna element, and up to a plurality of switches, wherein said switches are coupled to one or more portions of the antenna element for varying a length associated therewith;

wherein the antenna system is connected to at least one of: a receiver, or a transmitter.

3. The antenna system of claim 2, wherein said antenna element is selected from the group consisting of: a monopole, inverted F antenna (IFA), planar inverted F antenna (PIFA), Isolated Magnetic Dipole element (IMD), loop antenna, monopole element, and a dipole element.

4. An antenna system, comprising;

an impedance transformer connected to:

a first antenna element configured for radiation in a first frequency band, and a second antenna element configured for radiation in a second frequency band;

said first frequency band being distinct from said second frequency band, and said antenna system being configured for operation over a broad frequency range using said first and second antennas and associated frequency bands;

said first antenna element being coupled to a first active component, said first active component being configured to adjust a reactance of the first antenna element for optimizing performance of the antenna system; and said second antenna element being coupled to a second active component, said second active component being configured to adjust a reactance of the second antenna element for optimizing performance of the antenna system.

5. The antenna system of claim 4, further comprising a ferrite loaded coil element.

6. The antenna system of claim 5, wherein at least one active component is connected to said ferrite loaded coil element.

7. The antenna system of claim 4, wherein said impedance transformer comprises a metal-oxide-semiconductor field-effect transistor.

8. The antenna system of claim 4, wherein said active component is a varactor diode.

9. The antenna system of claim 4, wherein said impedance transformer is connected to said first and second antenna elements at a point of high voltage.

10. The antenna system of claim 4, further comprising a third antenna element configured for radiation in a third frequency band, the third frequency band being distinct from the first and second frequency bands, said third antenna element being coupled to a third active component, and said third active component being configured to adjust a reactance of the third antenna element for optimizing performance of the antenna system.

* * * * *